US011045822B2

(12) United States Patent
Duffin et al.

(10) Patent No.: US 11,045,822 B2
(45) Date of Patent: Jun. 29, 2021

(54) SPEED CONTROLLED NUTATING SPRINKLER

(71) Applicant: XCAD VALVE AND IRRIGATION, INC., Paul, ID (US)

(72) Inventors: Don Duffin, Paul, ID (US); Roger Duffin, Paul, ID (US); Casey Nutt, Paul, ID (US)

(73) Assignee: XCAD VALVE AND IRRIGATION, INC., Paul, ID (US)

( * ) Notice: Subject to any disclaimer, the term of this patent is extended or adjusted under 35 U.S.C. 154(b) by 0 days.

(21) Appl. No.: 16/733,082

(22) Filed: Jan. 2, 2020

(65) Prior Publication Data

US 2020/0222922 A1 Jul. 16, 2020

Related U.S. Application Data

(60) Provisional application No. 62/787,530, filed on Jan. 2, 2019.

(51) Int. Cl.
*B05B 3/00* (2006.01)
*B05B 3/04* (2006.01)

(52) U.S. Cl.
CPC ..... *B05B 3/008* (2013.01); *B05B 3/005* (2013.01); *B05B 3/006* (2013.01); *B05B 3/0486* (2013.01)

(58) Field of Classification Search
CPC ..... B05B 3/005; B05B 3/006; B05B 3/008; B05B 3/0486; Y10S 239/11
See application file for complete search history.

(56) References Cited

U.S. PATENT DOCUMENTS

| | | | | |
|---|---|---|---|---|
| 5,141,158 | A | 8/1992 | Allen | |
| 5,381,960 | A | 1/1995 | Sullivan | |
| 5,950,927 | A * | 9/1999 | Elliott | B05B 3/008 239/222.21 |
| 6,176,440 | B1 * | 1/2001 | Elliott | B05B 3/008 239/222.21 |
| 6,932,279 | B2 | 8/2005 | Burcham | |
| 7,287,710 | B1 | 10/2007 | Nelson | |
| 7,562,833 | B2 | 7/2009 | Perkins | |
| 8,991,724 | B2 | 3/2015 | Sesser | |

(Continued)

FOREIGN PATENT DOCUMENTS

WO WO2007109298 A3 9/2007

*Primary Examiner* — Alex M Valvis
(74) *Attorney, Agent, or Firm* — Scott D. Swanson; Shaver & Swanson, LLP

(57) ABSTRACT

A sprinkler head having a nutating fluid distribution cage. The sprinkler head has a first sprinkler body and a second sprinkler body. The first sprinkler body has an upper plate and a lower plate. A distribution cage is configured to hang from the lower plate when fluid is not being sprayed onto the cage. An upper cage plate of the distribution cage is configured to nutate between the upper plate and the lower plate when fluid is sprayed on the cage. The second sprinkler body is positioned below the cage and is connected to the first sprinkler body by one or more arms. The cage has a magnet coupled with a magnet of the second sprinkler body. The magnetic coupling allows the cage to hang at an angle from the lower sprinkler body plate when fluid is not sprayed onto the cage and/or to provide for a speed dampener of the rate of nutation of the cage.

6 Claims, 3 Drawing Sheets

(56) References Cited

U.S. PATENT DOCUMENTS

| | | | | |
|---|---|---|---|---|
| 8,998,109 | B2 * | 4/2015 | Katzman | B05B 3/005 239/252 |
| 10,239,066 | B2 | 3/2019 | Sesser | |
| 2011/0031332 | A1 | 2/2011 | Sesser | |
| 2012/0318888 | A1 | 12/2012 | Gandin | |

* cited by examiner

SPEED CONTROLLED NUTATING SPRINKLER

PRIORITY/CROSS-REFERENCE TO RELATED APPLICATIONS

This application claims the benefit of U.S. Provisional Application No. 62/787,530, filed Jan. 2, 2019, the disclosure of which is incorporated by reference.

TECHNICAL FIELD

The disclosure generally relates to the field of sprinkler dampening devices utilizing a magnetic dampener. Particular embodiments relate to utilizing a magnetic dampening device that serves as a starter for a nutating sprinkler mechanism or has an additional magnetic starting mechanism.

BACKGROUND

Various protrusions have been used on nutating sprinklers to not allow the distributor to sit level on startup. However, most if not all of these protrusions only slightly tilt the distributor so as to not be contacted during full nutation. The closer the distributor sits to level on startup, the greater the chance that it will stall. Further, these protrusions are subject to mechanical wear. What is needed is a distributor that is positioned at a more tilted angle relative to the angle at which fluid is sprayed from a nozzle. What is further needed is a sprinkler head that allows for magnetic dampening of the speed of rotation of the nutating distributor during use.

SUMMARY

The purpose of the Summary of the Invention is to enable the public, and especially the scientists, engineers, and practitioners in the art who are not familiar with patent or legal terms or phraseology, to determine quickly from a cursory inspection, the nature and essence of the technical disclosure of the application. The Summary of the Invention is neither intended to define the invention of the application, which is measured by the claims, nor is it intended to be limiting as to the scope of the invention in any way.

The present inventive concepts are directed to a fluid distributing sprinkler head. The fluid distributing sprinkler head has a fluid delivery tube with an attached fluid nozzle. A first sprinkler body partially encloses the fluid delivery tube and nozzle. The first sprinkler body has a first sprinkler body upper plate attached to the fluid delivery tube, a lower fluid delivery tube extending from the upper sprinkler body and a first sprinkler body lower plate attached to the lower end of the fluid delivery tube.

A fluid distribution cage is freely attached to the lower fluid delivery tube between the first sprinkler body upper plate and the first sprinkler body lower plate. The fluid distribution cage has a lower cage plate with a first and second side, and an upper cage plate with a first and second side. The upper cage plate and the lower cage plate are held in a spaced apart relationship by one or more cage arms. The upper cage plate defines a passage for the fluid delivery tube. The lower cage plate has a lower cage plate magnet. Preferably the lower cage plate magnet is positioned at the center of the lower cage plate. The fluid distribution cage is configured to hang from the second sprinkler body plate when fluid is not flowing through the sprinkler head nozzle and sprayed on the distribution cage. The lower cage plate first side has a generally peaked surface. The surface is preferably incised by spirally radiating grooves with a peak on said lower plate first side centrally positioned and having a beveled top surface A second sprinkler body is positioned below the fluid delivery cage. The second sprinkler body comprises a magnet that magnetically couples with the magnet in the fluid distribution cage. In a preferred embodiment, the magnetic coupling causes the fluid distribution cage to hang at an angle relative to the first sprinkler body lower plate. The fluid distribution cage being tilted to the first sprinkler body lower plate facilitates the initiation of nutation of the fluid distribution cage about the first sprinkler body lower plate.

The fluid distribution cage is configured to hang from said sprinkler body lower plate when said cage is without fluid and said sprinkler head is in a vertical position. The bevel on the lower cage plate is configured for deflection by an initial jet of fluid from said fluid directing tube, to initiate a nutating motion in said cage after said initial deflection with said nutating motion maintained by the force of fluid on said spirally radiating grooves.

In a preferred embodiment the second sprinkler body has a magnetic dampening mechanism configured to slow the rate of nutation of the fluid distribution cage when fluid is sprayed from said nozzle onto said lower cage plate. The magnetic dampening mechanism is magnetically coupled to the lower cage plate magnet. The magnetic dampening mechanism can further serve as the magnet that holds the fluid distribution cage at a tilted orientation to the first sprinkler body lower plate. The magnets in the sprinkler head can serve to provide the tilted orientation of the fluid distribution cage to the first sprinkler body lower plate, can serve to dampen the nutational speed of the fluid distribution cage, or both.

In a preferred embodiment the magnetic dampening mechanism comprises a rotor. The rotor is positioned within a housing comprising a viscous fluid. Preferably the rotor is attached to or integral with an axle that allows for rotation of the rotor. Preferably the rotor is in a disc shape. The lower sprinkler body magnet is positioned on or in said rotor and magnetically coupled to said lower cage plate magnet such that when said fluid distribution cage is nutating the rotor is configured to rotate within the housing. Drag caused by the rotation of the rotor in the viscous fluid in the housing dampens the speed of nutation of the fluid distribution cage. The rotor itself can be a magnet, the magnet can be integral with the rotor, the magnet can be removable from the rotor, and/or the magnet can be positioned on the rotor. Alternatively multiple magnets may be used.

Still other features and advantages of the claimed invention will become readily apparent to those skilled in this art from the following detailed description describing preferred embodiments of the invention, simply by way of illustration of the best mode contemplated by carrying out my invention. As will be realized, the invention is capable of modification in various obvious respects all without departing from the invention. Accordingly, the description of the preferred embodiments are to be regarded as illustrative in nature, and not as restrictive in nature.

DETAILED DESCRIPTION OF THE EXEMPLARY EMBODIMENTS

Figure 1:
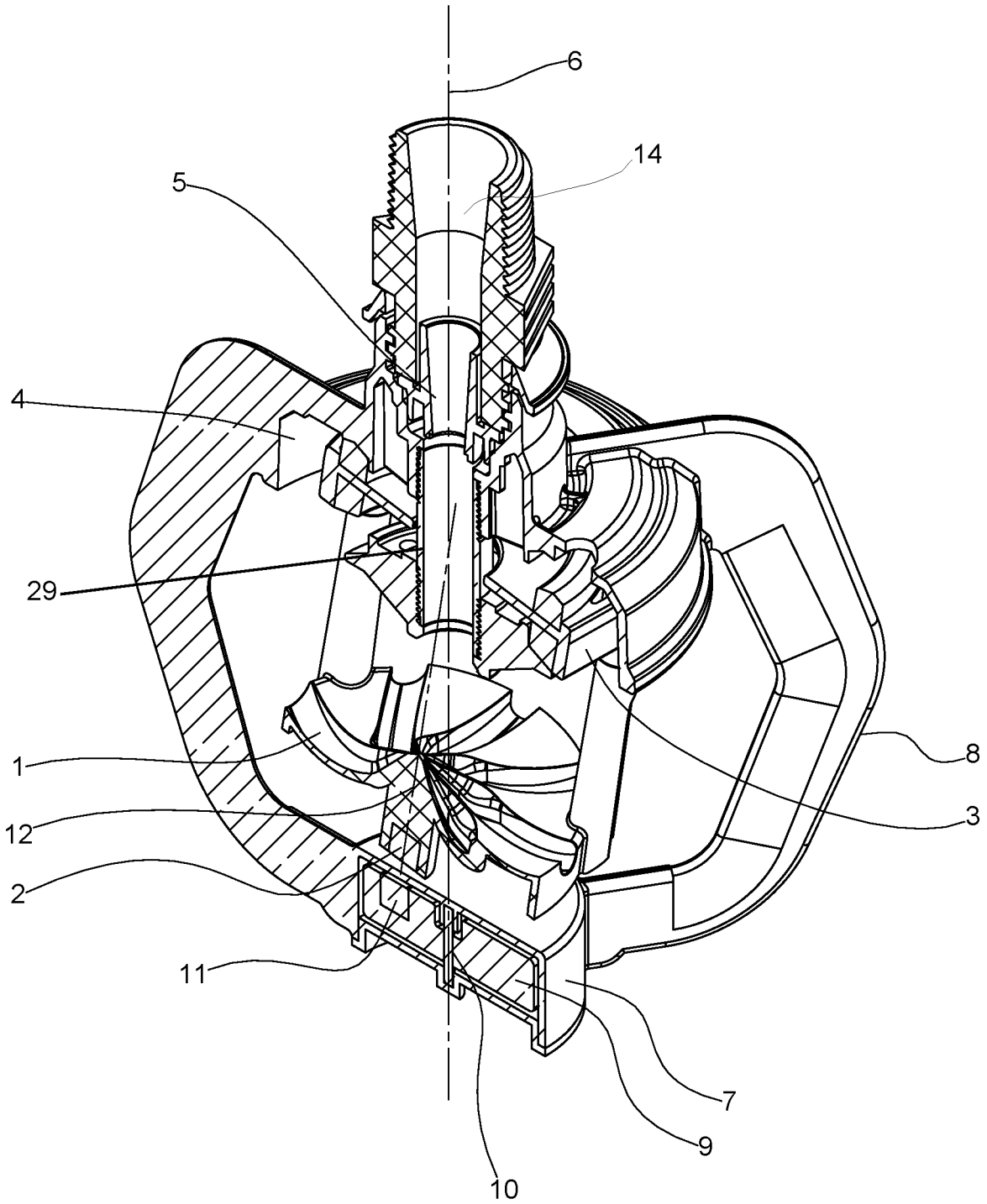
FIG. 1 is a perspective cutaway view of a sprinkler having a magnetic speed control mechanism.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined herein.

In the following description and in the figures, like elements are identified with like reference numerals. The use of "e.g.," "etc," and "or" indicates non-exclusive alternatives without limitation unless otherwise noted. The use of "including" means "including, but not limited to," unless otherwise noted.

Figure 2:
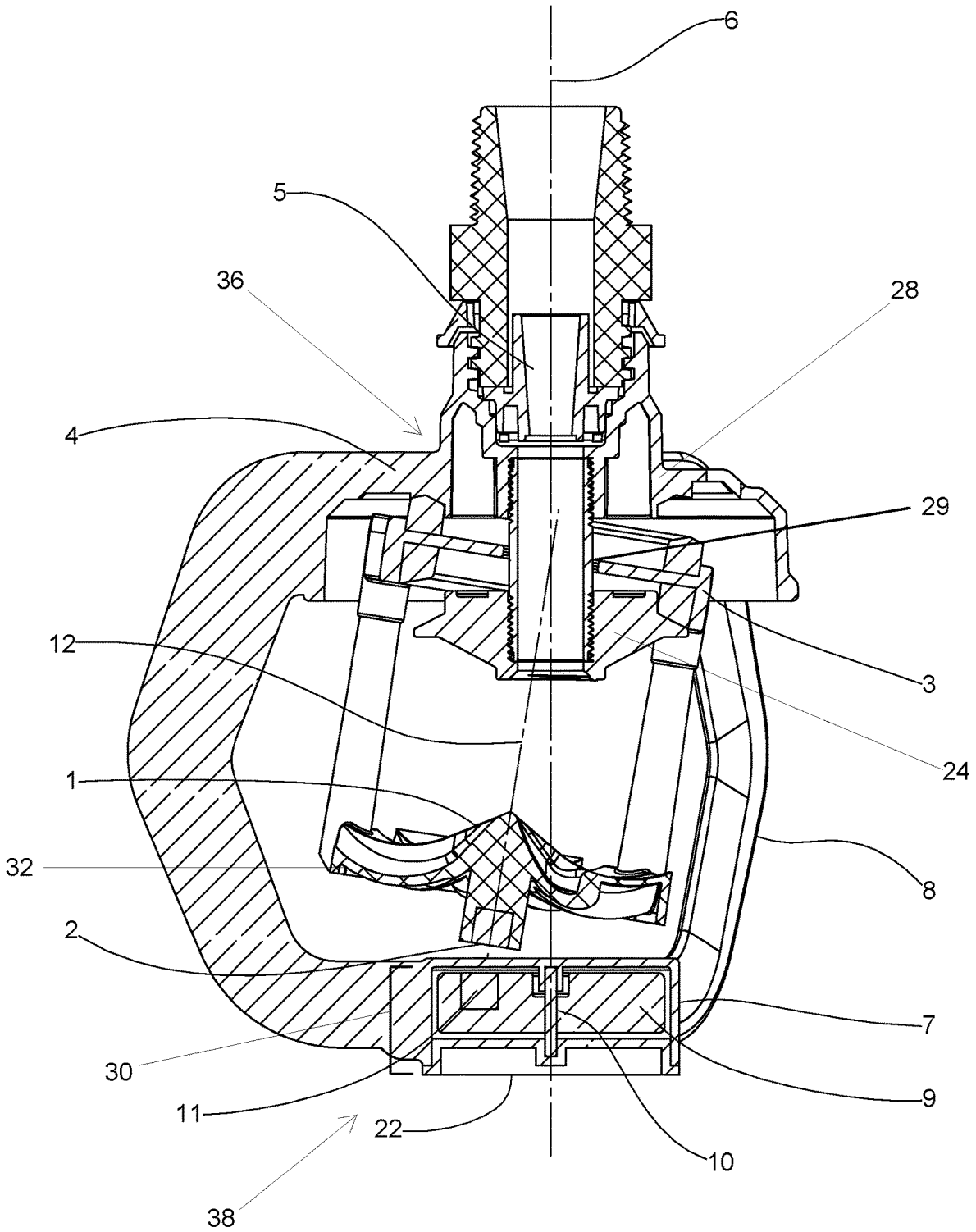
FIG. 2 is a side cutaway view of a sprinkler having a magnetic speed control mechanism.
Figure 3:
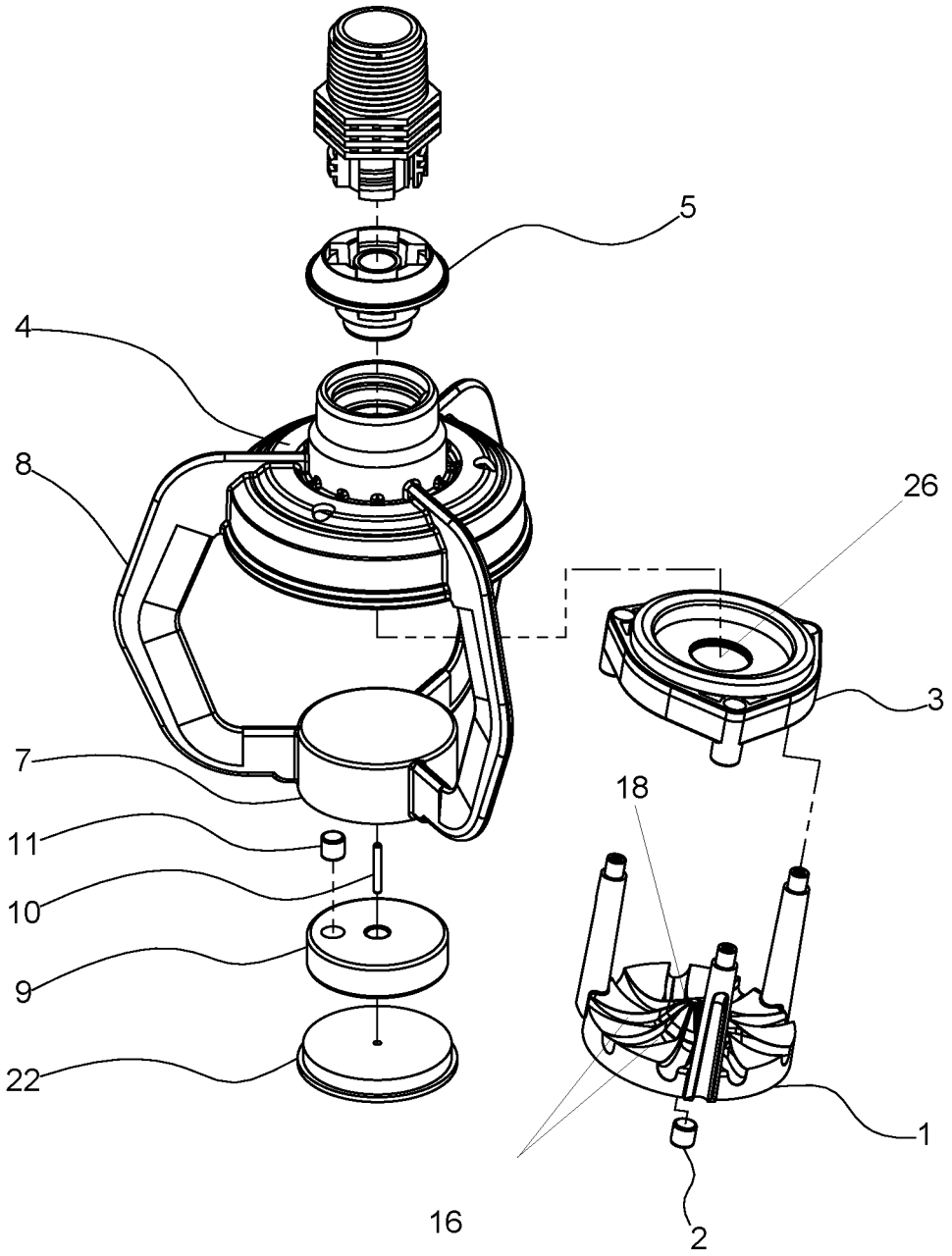
FIG. 3 is a perspective exploded view of a sprinkler having a magnetic speed control mechanism.

A preferred embodiment of the disclosed technology is shown FIGS. 1 through 3. FIG. 1 shows an embodiment of a sprinkler head, in what will be termed a vertical orientation. The sprinkler head can operate in an inverted orientation, but the orientation shown in the figures will be termed vertical, as regards parts with a "top" side or a "bottom" side. Embodiments of the disclose sprinkler include a sprinkler distributor [1] including a magnet [2] and an upper distributor plate [3] are attached to a sprinkler main body [4] such that the distributor, magnet, and upper distributor plate are allowed to rock as they rotate (also called to nutate). The sprinkler body has a first sprinkler body [36] and a second sprinkler body 1381. The first sprinkler body has a first sprinkler body upper plate [28] and a first sprinkler body lower plate [24]. The first sprinkler body lower plate [24] and the first sprinkler body upper plate are positioned in a spaced apart relationship by the lower fluid distribution tube [29]. The sprinkler main body includes a nozzle [5] positioned within a fluid delivery tube 1141 that sprays a stream of fluid along the sprinkler's central axis [6] through the lower fluid delivery tube [29] onto the distributor. The distributor has spirally radiating grooves [16] that redirect the fluid from the nozzle to spray outward from the sprinkler. Preferably the distributor has a peak [18] having a beveled top surface from which the spirally radiating grooves radiate. A second body [7] is attached to the sprinkler main body by one or more arms [8]. When fluid is sprayed onto the distributor, the force of the fluid spraying on the distributor causes the upper distributor plate [3] to nutate between the first sprinkler body upper plate and first sprinkler body lower plate.

The sprinkler utilizes a magnetic dampening mechanism for controlling the speed of nutation of the cage on the sprinkler. In a preferred embodiment, the second body having a magnetic dampener [30] encloses a rotor [9] that is connected to the second body with a shaft [10] so that the rotor spins about the sprinkler's central axis. The shaft may or may not be part of the rotor. The rotor preferably is configured as a disc. The rotor also contains the lower sprinkler body magnet [11] that attracts the lower cage plate magnet. The lower sprinkler body magnet can be integral with the rotor or positioned on or within the rotor. Alternatively the rotor as a whole can be configured as a magnet. The second body preferably houses a viscous fluid such that the viscous fluid surrounds the rotor and magnet. In an alternate embodiment the magnetic speed control mechanism utilizes an eddy current dampener as disclosed in U.S. patent application Ser. No. 16/675,079, the contents of which are hereby incorporated by reference. Alternate magnetic speed dampener designs can also be utilized.

The lower sprinkler body magnet attracts the lower cage plate magnet which tilts the distributor into a position so that the distributor axis [12] misaligns with the sprinkler main axis. As the sprinkler sprays a stream of fluid through the nozzle onto the distributor, the distributor redirects the fluid through the grooves such that the fluid sprays outward and the distributor starts to nutate about the sprinkler's main axis. As the distributor nutates, the lower cage plate magnet revolves about the sprinkler's main axis which causes the lower sprinkler body magnet to also rotate at the same rate due to the magnetic attraction, which spins the rotor about the sprinkler's main axis. As the rotor spins, the viscous fluid resists the motion, keeping the rotor from spinning quickly which also slows the nutation of the distributor due to the magnetic attraction.

The use of a dampener on a nutating sprinkler distributor increases the sprinkler's whetted diameter by reducing the amount of the fluid's kinetic energy that is used to move the distributor. Nutating sprinkler distributors redirect the flow of fluid from the nozzle at an angle such that the fluid nutates the distributor which converts some of the fluid's kinetic energy into the distributor's kinetic energy. Dampening the motion of the distributor allows the fluid to maintain more kinetic energy, allowing the fluid to travel farther, increasing the sprinkler's whetted diameter.

The magnets also keep the distributor tilted before the sprinkler starts. If the distributor is allowed to sit level on startup, the stream of fluid hits the center of the pad and does not move the distributor to the side which is required to start the nutating motion. If the distributor does not start to nutate when hit by the fluid it stalls and does not work properly. The magnet holds the distributor at full tilt on startup which better reduces the chance of it stalling. Using a magnet to tilt the distributor, instead of a protrusion, also reduces mechanical wear during sprinkler startup and shutoff, and reduces geometry that foreign debris can get caught on.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

While certain exemplary embodiments are shown in the Figures and described in this disclosure, it is to be distinctly understood that the presently disclosed inventive concept(s) is not limited thereto but may be variously embodied to practice within the scope of this disclosure. From the foregoing description, it will be apparent that various changes may be made without departing from the spirit and scope of the disclosure as defined herein.

What is claimed is:

1. A fluid distributing sprinkler head, comprising, a fluid delivery tube;

a lower fluid delivery tube in fluid connection with said fluid delivery tube;

a fluid nozzle configured to receive fluid from said fluid delivery tube and to direct said fluid through said lower fluid delivery tube;

a first sprinkler body partially enclosing said fluid delivery tube, wherein said first sprinkler body comprises a first sprinkler body upper plate attached to said fluid delivery tube and a first sprinkler body lower plate attached to said lower fluid delivery tube such that said first sprinkler body upper plate and said first sprinkler body lower plate are spaced apart by said lower fluid delivery tube;

a fluid distribution cage, said fluid distribution cage with a lower cage plate with a first and second side, and an upper cage plate with a first and second side, with said upper cage plate and said lower cage plate held in a spaced apart relationship by one or more cage arms, wherein said lower cage plate comprises a lower cage plate magnet, with said upper cage plate defining a passage for said lower fluid delivery tube, wherein said upper cage plate is freely attached to said lower fluid delivery tube through said passage in said upper cage plate such that said upper cage plate is positioned between said first sprinkler body upper plate and said first sprinkler body lower plate;

said lower cage plate first side having a peaked surface, said surface incised by spirally radiating grooves with a peak on said lower plate first side centrally positioned and having a beveled top surface;

wherein said fluid distribution cage is configured to hang from said sprinkler body lower plate when said fluid distribution cage is without fluid and said sprinkler head is in a vertical position, with said bevel on said lower cage plate configured for deflection by an initial jet of fluid from said fluid directing tube, to initiate a nutating motion in said fluid distribution cage after said initial deflection with said nutating motion maintained by the force of fluid on said spirally radiating grooves; and a second sprinkler body positioned below said fluid delivery cage, wherein said second sprinkler body comprises a magnetic dampener comprising a rotor having a lower sprinkler body magnet offset from a central axis configured for magnetic attraction to said lower cage plate magnet such that when said distribution cage is nutating said rotor within said magnetic dampener is configured to spin due to the attraction between the lower cage plate magnet and said rotor, wherein rotation of said rotor configured to slow the rate of nutation of said fluid distribution cage when fluid is sprayed from said nozzle onto said lower cage plate.

2. The sprinkler head of claim 1, wherein said rotor is positioned within a housing comprising a viscous fluid such that said viscous fluid provides drag to the rotation of said rotor thus slowing rotation of said rotor and thus slowing nutation of said cage.

3. The sprinkler head of claim 2, wherein said lower sprinkler body magnet is integral with said rotor.

4. The sprinkler head of claim 2, wherein said rotor comprises a disc.

5. The sprinkler head of claim 1 wherein said lower cage plate magnet is positioned at a center of said lower cage plate.

6. The sprinkler head of claim 1 wherein said first sprinkler body is connected to said second sprinkler body by three arms.

* * * * *